US007306000B1

(12) United States Patent
Nezat, II

(10) Patent No.: US 7,306,000 B1
(45) **Date of Patent: *Dec. 11, 2007**

(54) LARGE SCALE TUBULAR LINE CLEANING SYSTEM

(76) Inventor: Malvin A. Nezat, II, P.O. Box 1419, Spendora, TX (US) 77372

( * ) Notice: Subject to any disclaimer, the term of this patent is extended or adjusted under 35 U.S.C. 154(b) by 606 days.

This patent is subject to a terminal disclaimer.

(21) Appl. No.: 10/710,658

(22) Filed: Jul. 27, 2004

Related U.S. Application Data

(63) Continuation-in-part of application No. 10/707,159, filed on Nov. 24, 2003.

(51) Int. Cl.
*B08B 3/00* (2006.01)

(52) U.S. Cl. ..... 134/166 C; 134/166 R

(58) Field of Classification Search ..... 134/166 C, 134/166 R
See application file for complete search history.

(56) References Cited

U.S. PATENT DOCUMENTS

| | | | | |
|---|---|---|---|---|
| 1,033,587 | A | 7/1912 | Hodgman | |
| 1,035,994 | A | 8/1912 | Mueller | |
| 1,437,007 | A | 11/1922 | Otterson | 210/241 |
| 1,437,008 | A | 11/1922 | Otterson | 210/241 |
| 1,561,744 | A | 11/1925 | Raymond | 210/532.1 |
| 1,803,425 | A | 5/1931 | Cunningham | 15/104.31 |
| 2,481,152 | A | 9/1949 | Redmond, Sr. | 15/104.061 |
| 2,508,659 | A | 5/1950 | Brown | 15/104.061 |
| 2,522,077 | A | 9/1950 | Wahl et al. | 414/502 |
| 2,782,929 | A | 2/1957 | Colket | 210/532.1 |
| 3,056,156 | A | 10/1962 | Immel | 15/104.06 |
| 3,380,461 | A | 4/1968 | Maasberg et al. | 134/167 C |
| 3,463,172 | A | 8/1969 | Naylor | 134/169 R |
| 4,073,302 | A | 2/1978 | Jones | 134/167 C |
| 4,141,753 | A | 2/1979 | Creed | 134/8 |
| 4,271,556 | A | 6/1981 | Farrell, Jr. | 15/104.31 |
| 4,367,145 | A | 1/1983 | Simpson et al. | 210/241 |
| 4,543,183 | A | 9/1985 | Petretti | 210/187 |
| 4,676,301 | A | 6/1987 | Sakamoto | 165/95 |
| 4,699,163 | A | 10/1987 | Baziuk | 134/167 C |
| 4,718,142 | A | 1/1988 | Wahlers | 15/395 |
| 4,790,356 | A | 12/1988 | Tash | 138/93 |
| 4,816,167 | A | 3/1989 | Vanderslice | 210/776 |
| 4,865,062 | A | 9/1989 | Tash | 134/167 C |
| 4,957,123 | A | 9/1990 | McHugh | 134/167 C |
| 5,122,193 | A | 6/1992 | Derlein | 134/22.11 |
| 5,244,505 | A | 9/1993 | Allison et al. | 134/22.11 |
| 5,336,333 | A | 8/1994 | Sheppard et al. | 134/22.11 |
| 5,341,539 | A | 8/1994 | Sheppard et al. | 15/302 |

(Continued)

*Primary Examiner*—Michael Barr
*Assistant Examiner*—Jason Heckert
(74) *Attorney, Agent, or Firm*—Marsteller & Associates, P.C.

(57) ABSTRACT

A large scale cleaning plug (L) adaptable to be placed within an interior passageway (10) of a tubular system (14) includes a frame structure (208) with a first and second end (202 and 204) supporting an outer skin member (200) for directing a fluid (F) through an interior passageway formed in the skeletal frame structure (208). A middle section (300) of the frame (208) has a generally frustoconical shaped bottom (302). A rigging (236) connected to the frame (208) controllably secures the frame structure (208) in desired positions. The frame's second end (204) supports at least one nozzle assembly (220) having at least one nozzle body (222) extending from a plate (226) preventing appreciable fluid flow therethrough and permitting a desired fluid flow through an exit opening (223) of the nozzle bodies (222).

18 Claims, 5 Drawing Sheets

U.S. PATENT DOCUMENTS 5,364,473 A 11/1994 Van Der Does ..... 134/8
5,380,427 A 1/1995 Foss ..... 210/95
5,417,851 A 5/1995 Yee ..... 210/167
5,444,887 A 8/1995 Rufolo ..... 15/104.31
5,580,393 A 12/1996 Lawther ..... 134/8
5,720,309 A 2/1998 Baziuk ..... 134/167 C
5,868,858 A 2/1999 Creed ..... 134/8
5,875,803 A 3/1999 Leitko et al. ..... 134/167 C
6,508,261 B1 1/2003 Nezat
6,527,869 B1 3/2003 Bourg ..... 134/1
6,764,604 B1 7/2004 Nezat ..... 210/800

LARGE SCALE TUBULAR LINE CLEANING SYSTEM

This application is a Continuation-in-part of application Ser. No. 10/707,159, filed on Nov. 24, 2003.

BACKGROUND ART

1. Technical Field

The invention relates to the field of ductwork or pipe interior cleaning systems and more particularly to a large scale type cleaning plug apparatus for cleaning the interior of large interior diameter ducts or pipes such as sewer lines for example.

2. Background Art

Cleaning plugs or kites are well known and have been used generally by cleaners of waste collection systems, air duct work, and the like for loosening solid materials, such as dirt, stone, mud and other debris, from the interior walls of pipes or ducts.

Kites and other types of cleaning plugs are well known in the pipe cleaning art. For example, U.S. Pat. Nos. 5,336,333; 5,341,539; 5,068,940; 1,035,994; 2,481,152; 2,508,659; 4,141,753; 5,364,473; and 6,508,261 teach various embodiments of cleaning plugs or kites for use in the cleaning of the interior of pipes.

A cleaning plug or kite may be placed in the interior either of a pipe, such as a sewer line, or a duct, such as an air handling or air conditioning system in a building. The fluid flowing in the pipe is blocked by the bag device thereby expanding the first end of the kite. Generally, the first end of the kite is sized such that when the kite is fully expanded the first end approximates the size or diameter of the interior of the pipe. The fluid flow is then either totally stopped or a pressurized stream may flow between the outer edge of the kite and the interior wall of the pipe. Alternatively, an opening may be formed in the apex of the kite or bag to permit fluid flow therethrough. Such flow through the formed opening would increase the pressure of the resulting stream exiting through the kite as a result of the fluid flowing through a reduced cross-sectional area. Finally, the pulling of the rigging securing the kite or cleaning plug against the fluid pressure in the pipe often creates pockets or folds in the outer edge of the first end of the kite. Pressurized fluid jets or streams then can escape between the folds and the pipe's interior wall.

The relatively high pressure water or fluid is used to flush or wash undesired solid debris downstream through the pipe system.

Check valves are also well known in the art pertaining to valve structures. A check valves is a valve that permits flow in one direction only, that is to prevent backflow. Check valves have been used in past wastewater systems, such as in sluice gates. Known types of check valves include dual plate hinged and also all-rubber construction that seals and closes. An exemplary offeror of metal-hinged check valves is Techno Corporation of Millbury, Mass. (www.technovalve.com). Other check valve offerors are available and can be found readily through searching for check valves on the Internet.

Such a known check valve has not been used in the field of cleaning plugs or kites prior to the teaching of U.S. Pat. No. 6,508,261, issued Jan. 21, 2003 to the present Applicant.

However, the prior cleaning plugs or kites work optimally when the entire interior of the pipe was flooded or filled with the liquid. This optimal situation is not always feasible defeating the effectiveness of the known cleaning plugs or kites. A commonly occurring situation in which the entire interior of a pipe is not filled with a liquid is with a large diameter sewer pipe of the type having an interior passageway large enough to fit a standing person. In such large scale sewer systems, the level or depth of fluid flowing in the passageway may be only a few inches or a fraction of the passageway's diameter.

While the above-cited references introduce and disclose a number of noteworthy advances and technological improvements within the art, none completely fulfills the specific objectives achieved by this invention.

While the above cited references introduce and disclose a number of noteworthy advances and technological improvements within the art, none completely fulfills the specific objectives achieved by this invention.

BEST MODE FOR CARRYING OUT THE INVENTION

In accordance with the present invention, the present large scale cleaning plug system (L) is adaptable to be placed within an interior passageway of a tubular system having a larger interior diameter that the above described kites or cleaning systems. The cleaning plug includes a skeletal frame structure that is adapted to support an outer skin member for containing and directing a fluid through an interior central passageway formed in the skeletal frame structure. The skeletal frame structure is formed having a first end and an opposing second end. The first end is defined as being upstream of the second end in relation to a fluid flow path through the interior passageway of the tubular system during operation of the large scale cleaning plug (L). The first end is also formed having an opening therethrough for the passage of the fluid.

The skeletal frame structure has a middle segment comprising a generally frustoconically shaped bottom element that itself has a first end and a truncated opposite second end. The first end through to the second end of the middle segment has a width selected to fit within the interior passageway of the tubular system.

A securing means may be connected to the skeletal frame structure in proximity to the first end for controllably securing the skeletal frame structure in desired positions within the interior passageway of the tubular system.

The second end of the skeletal frame structure is formed having a rear segment that supports at least one nozzle assembly. The nozzle assembly includes at least one nozzle body that extends from a plate preventing appreciable fluid flow therethrough while at the same time permitting a desired fluid flow through an exit opening of the nozzle bodies.

These and other objects, advantages and features of this invention will be apparent from the following description taken with reference to the accompanying drawings, wherein is shown the preferred embodiments of the invention.

BRIEF DESCRIPTION OF THE DRAWINGS

A more particular description of the invention briefly summarized above is available from the exemplary embodiments illustrated in the drawings and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

DISCLOSURE OF INVENTION

So that the manner in which the above recited features, advantages, and objects of the present invention are attained can be understood in detail, more particular description of the invention, briefly summarized above, may be had by reference to the embodiment thereof that is illustrated in the appended drawings. In all the drawings, identical numbers represent the same elements.

Figure 1:
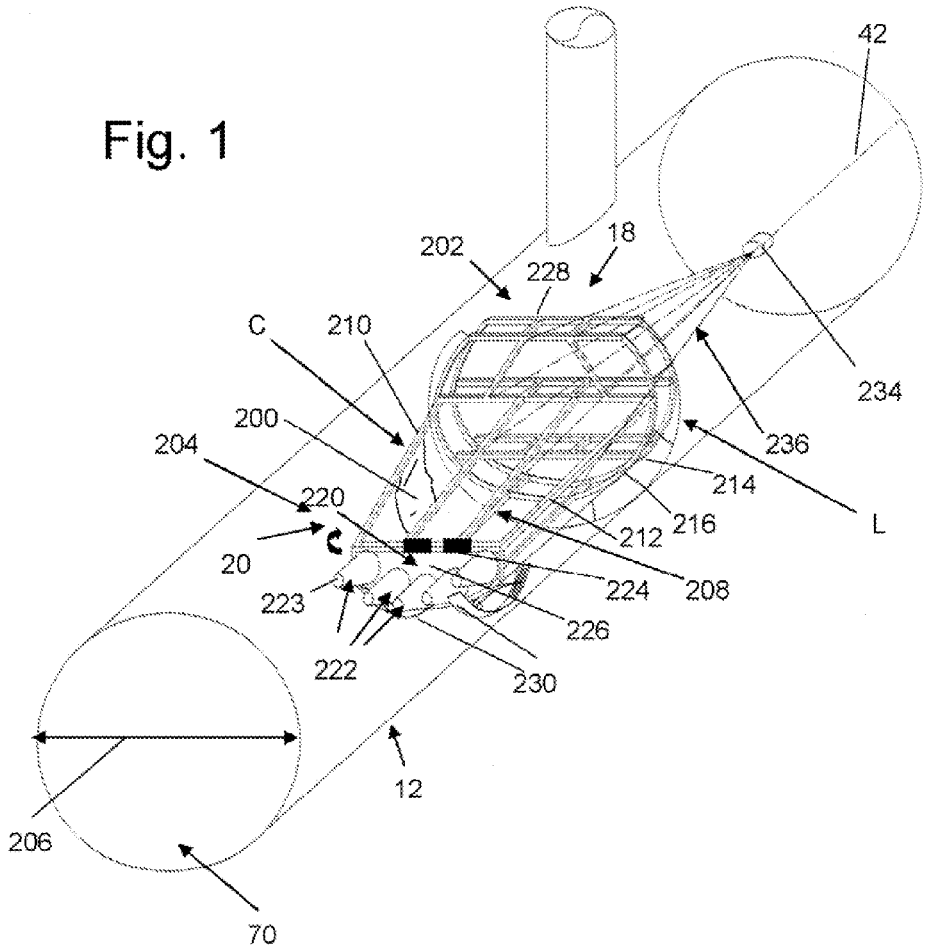
FIG. 1 is a right front isometric view of a prior kite or cleaning plug within a pipe system.
Figure 2:
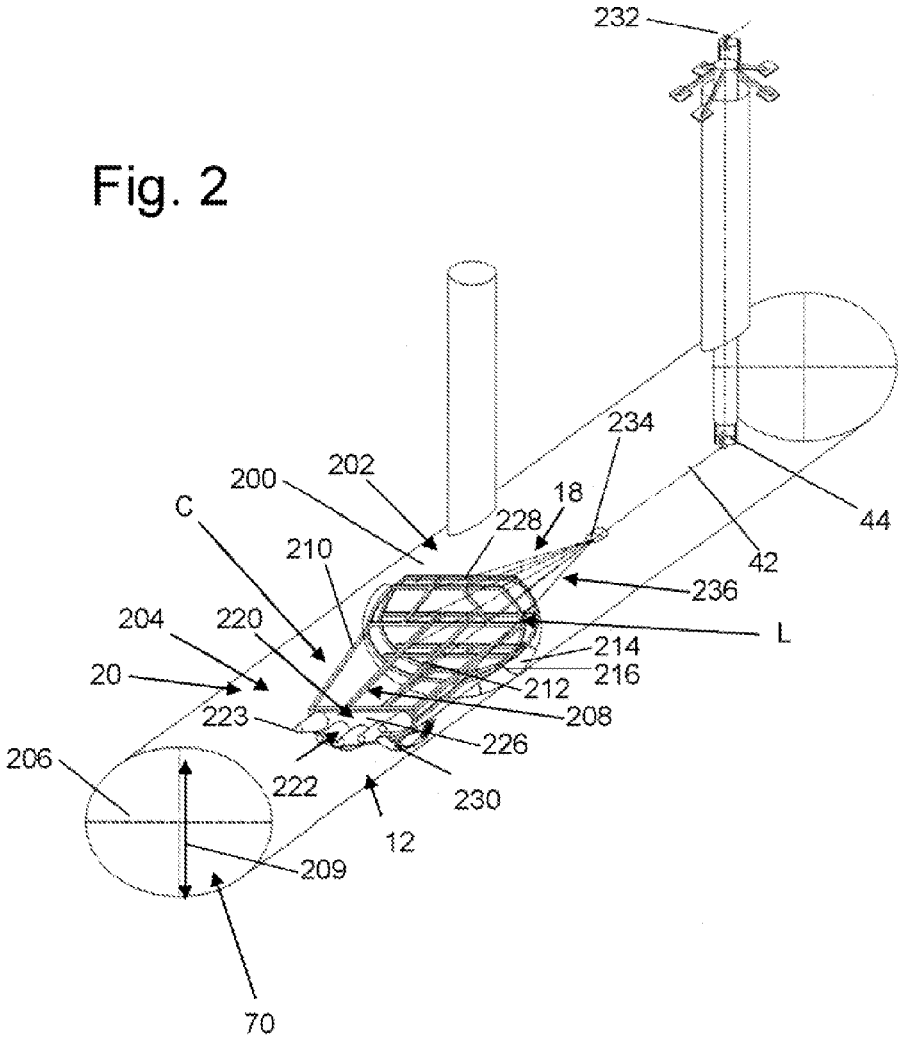
FIG. 2 is another right front isometric view of a pipe system with a winch mounted to support a cleaning plug.
Figure 3:
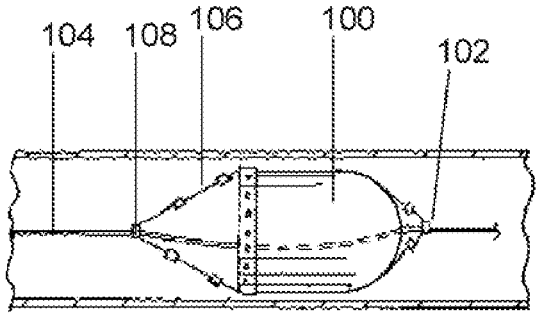
Fig. 3 Prior Art
FIG. 3 is an elevational view of one embodiment of a prior art kite.
Figure 4:
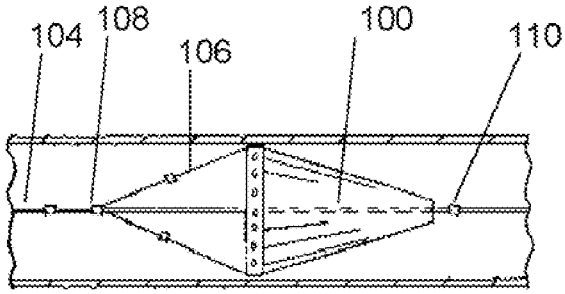
Fig. 4 Prior Art
FIG. 4 is an elevational view of another embodiment of a prior art kite.
Figure 5:
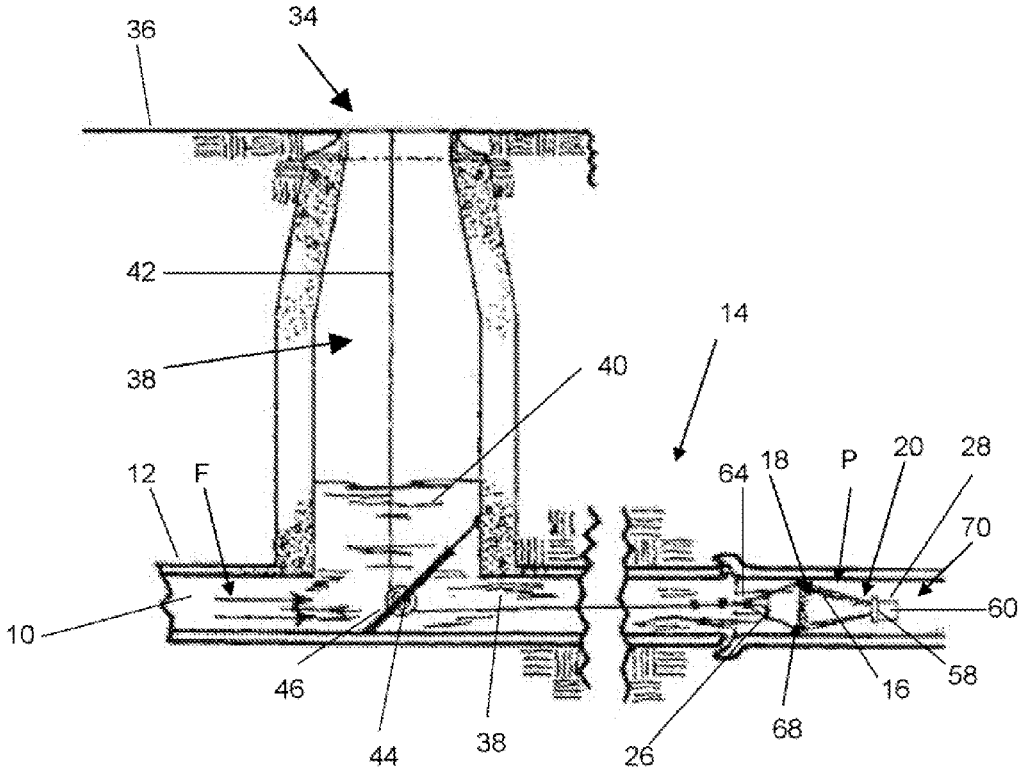
Fig. 5 Prior Art
FIG. 5 is a schematic diagram of an embodiment of another known kite invention within a tubular system, such as a sewer line.

FIGS. 1 and 2 show a prior embodiment of a large scale kite cleaning system as described in co-pending application Ser. No. 10/707,159, filed Nov. 24, 2003. FIGS. 3, 4 and 5 teach three prior art embodiments of kites or cleaning plugs. FIG. 3 shows a bag or kite (100) having a manually releasable end (102) to collapse the kite that is effective to prevent damage from and over pressurization of the pipe being cleaned or to make the extraction of the cleaning kite from the pipe or duct work easier. A cable (104) attached to rigging (106) at connection point (108) is secured to the kite (100).

FIG. 4 shows a kite (100) with a manually releasable plug (110) attached to a rope extending through the interior of the kite. Normally, the plug (110) is pulled to seal the open end of the kite or sleeve (100), but the introduction of slack in the plug line would permit the plug (110) to back away from the open end of the kite (100) and thereby opening the end of the kite (100) permitting fluid flow therethrough.

In FIG. 5 the cleaning plug (P) is adaptable to be placed within an interior passageway (10) of a tube or duct (12) within a tubular system (14). The plug (P) includes a bag or generally conically shaped element (16) that has a first end (18) and an opposite second end (20). The first end (18) has a width or diameter (22) selected to fit within the interior passageway (10) of the tube (12). The second end (20) may have a width or diameter (24) that is less than the width (22) of the first end (18).

A securing system or rigging (26) is connected to the conical element (16) in proximity to the first end (18) for controllably securing the conical element (16) in desired positions within the interior passageway (10) of the tube or duct (12).

A valve assembly (28) is mounted with the second end (20) of the conical element (16). The valve assembly (28) has a normally closed position (30) preventing appreciable fluid flow therethrough and an open position (32) permitting fluid flow (F) through the valve assembly (28) upon sensing of a flow pressure therethrough greater than a minimum selected pressure value.

FIG. 5 is a schematic diagram of the known kite being used in a typical sewer system (14) having a fluid flow F of a liquid (40), such as water, with solid or particulate matter, but the sewer system shown could be any type of piping system or air duct work, such as an air conditioning system of a building. For the prior kite to work at full efficiency, the entire pipe diameter should be filled or flooded with the flowing liquid. With an air conditioning system, solid matter, such as dirt or dust, would line the interior walls of the air ducts and would be swept away with streams of pressurized air or other gas.

In FIG. 5 the tubular system (14) includes an access point or manhole (34) formed in the ground or surface (36). An interior connection member or channel (38) joins the manhole (34) and the interior channel (10) of the sewer line (12). The fluid or slurry of liquid and solid (40) fills at least a portion of the interior of the sewer system (12).

A rope or cable (42) traveling through the interior of the sewer system (14) extends between the surface (36) and a connection point (64) with the rigging (26) affixed to the conical element (16). The cable (42) restrains the kite (P) against being swept away in the flowing fluid (F) and controls the placement of the kite (P) within the pipe system (14). The cable (42) may optionally be supported around any corners by a pulley or wheel (44) attached to a brace (46) secured in the interior (10).

The width of the first end (18) of the sleeve or bag (16) is chosen such that a desired amount of fluid may flow between an outer edge of the first end portion (18) and the interior wall forming the interior passageway (10) through the tubular system (14).

The apex or second end (20) of the conical element (16) is shown with a flange or other mount joining the conical element (16) with the valve assembly (28). Preferably, the second end (20) is truncated forming an opening through which the fluid or slurry (40) may pass or flow.

The valve assembly (28) typically is a check valve type that permits fluid flow substantially only in one direction. The check valve is attached to the end of the open-ended sleeve or bag (16) such that desired fluid flow is permitted in the direction of travel from the first end (18) toward the second end (20) of the kite (P).

Known check valves can be formed from metal or an all-rubber construction. A wafer type of check valve may also be used. However, the weight of the valve assembly (28) acts to pull down the second end (20), and thus choosing a check valve having a lower weight is normally desired so as to be less of a drag on the sleeve (16). The weight of the valve assembly (28) and kite (P) is of particular concern when the pipe system is an air duct network and lightweight materials are desired.

The operator of the kite (P) would normally select the characteristics of the valve assembly (28) to match the anticipated fluid pressure in the sewer, the amount of fluid to flow through the valve assembly (28), the cross-sectional area of the opening (62), and the desired opening value for the valve assembly (28).

Generally, the check valve comprises a pipe or tube segment having a channel therethrough, and an exterior surface and an interior surface with one end (58) adapted to the mounted to been adjacent structure. An opposite end (60) is adapted to be normally pinched closed resembling a duck's bill unless a fluid pressure greater than a preset lower limit is introduced into the interior of the check valve pipe segment. When the fluid pressure in the interior of the check valve exceeds the minimum pressure, then the discharge end (60) opens forming a passageway therethrough permitting fluid flow. Although it is preferred that fluid flow be totally restricted in the closed position, typically a certain, comparatively small amount of the liquid can flow through the valve in the closed position.

An alternative embodiment of the duckbill type of check valve is shown in FIG. 3 in which the fluid pressure against the exterior surface of the check valve acts to open the check valve.

The conical element or bag (16) may be shaped like an open-ended sleeve, a windsock, a bag, or any other suitable shape taught by the prior art. The width of the second end (20) is preferably less than the width of the first end (18), but is a matter of choice or design. The conical element (16) should be made of a flexible material and can be made of nylon, rubberized or vinylized treated canvas, or any other material that is essentially impervious to the fluid flow therethrough.

The kite (P) is introduced into the interior passageway (10) of the sewer system (14) upstream of the area to be cleaned. The position of the kite (P) is controlled by the cable (42) attached to the rigging (26).

Water or other fluid flowing in the pipe system is blocked by the bag (16) of the kite (P) creating a hydrostatic head pressure behind (upstream) of the kite (P). The stopped water escapes under pressure either through the opening (62) in the valve assembly (28), or between the outer edge (68) of the first end (18) and the interior wall (70). Pulling in the rigging (26) may cause folds in the first end (18) thereby creating pressurized jets of water. The high-pressure streams of water are used to controllably flush or clean undesired solid debris downstream from the placement of the kite (P).

The Large Diameter Storm Sewer Cleaning System (L) of the earlier filed co-pending application included a conical element or body (C) formed having an outer screen, skin, or cone member (200) of canvas or other suitable material. The screen member (200) is generally shaped to receive water on the upstream side (202) and direct flow downstream (204) in a funnel type fashion as known, smaller kite systems. The large diameter screen member (200) is operated under the same principles as the known prior art kites.

Prior kites or cleaning plug systems have been utilized extensively on smaller diameter pipe (12), with the inherent ability to channel existing or additional subsequent added flow. Channeling the water flow (F) is done in a method that causes turbulence directly in front of the device. The turbulence is calculated based on critical velocities necessary to suspend pipe sediment. Additional flow around the prior cleaning plugs is also provided to carry sediment to a downstream lift station in advance of re-settling. The downstream lift station is strategically placed to remove suspended sediment. As is shown in FIG. 5 the kite (P) is slowly deployed via a constant tension winch upstream of the device (P) and connected to the kite (P) with the cable (42). Payout rates of the cable (42) can be adjusted according to rate of flow and sediment density.

The large scale kiting system (L) of FIGS. 1 and 2 differs from prior kite systems in that filling flooding the entire pipe interior diameter (206) with the fluid (F) is neither feasible nor required to stir sediment deposits. A light weight frame body (208) is assembled inside the pipe (12) and the shell (200) is secured to the frame (208), creating a predetermined shape based on flow rate analysis of the conditions. The primary frame members (210 and 212 as exemplary) are formed into a frustoconical frame structure that is configured to establish a truncated cone and nozzle footprint for the primary shell covering (200). The height of the frame body (208) provides additional weir height for canvas attachment should an increase in potential energy be required to establish critical velocities necessary for stirring sediment deposits.

A screening apron (214) optionally surrounds the primary frame body (208) and preferably toward the upstream end of the frame body (208). The apron (214) may be of a simple beam spring (216) nature, thus allowing the canvas or other selected shell material to follow the unknown interior pipe geometry or imperfections of the pipe wall contour, normally associated with the means or methods used during construction and adapt to any unforeseen obstacles or wear inside the pipe (12).

The downstream facing nozzle assembly or face (220) is provided with a plurality of generally frustoconical shaped openings (222) configured to direct flow with critical velocities to stir sediment. The nozzle face or assembly (220) is preferably of a prearranged hinge (224) mounting the back plate (226) to the downstream end of the frame body (208). The hinged mechanism (224) is held in the upright condition during the assembly of the remaining kite frame body (202), thus allowing natural water (F) flow. The face or back plate (226) is lowered into position as shown in FIG. 1 once the frame body (202) assembly nears completion. A piston (227) connected between the back plate (220) and the frame body (208) may optionally be used Once in position the nozzle face plate (226) to primary canvas frame body (202) is secured and sealed using a preloading mechanism. The plurality of nozzles (222) can be re-configured, i.e. openings and orientation without impacting the primary structural frame (202) and canvas kite.

The plurality of openings (222) may alternatively be formed from check valves or duck-billed types of check valves as described above. It is preferred that the direction of the fluid flowing out of the openings (222) be able to be directed toward the bottom of the inside walls (70) of the sewer pipe (12).

Generally, each of the plurality of openings or nozzles (222) may be an individual, but smaller truncated cone structure having an exit end (223). Alternatively, each nozzle (222) may be formed from a known kite such as shown in FIG. 3.

The structural frame body (208) provides a shell for the outer shell member (200) that acts to restrain the passage of the fluid (F) and creates a truncated cone configuration that is inherently shaped to gather flow on the upstream side (202) and funnel the fluid flow to the nozzle face openings. The frame body (208) is designed to maintain the predetermined shape and is provided with fastening points. Assembly of the frame body (208) is performed inside the storm sewer pipe (12) by means of pins and bolts or the like. Components of the structural frame (208) are designed to fit within the constraints of a 30 inch manhole opening for example.

Alternatively, the frame body (208) and outer shell or skin member (200) may be formed from a single rigid skin member such that when the frame body (208) is assembled, there is no need for a separate shell member (200).

The upper most section of the primary structural kite frame (208) is provided with attachment points for an optional weir or dam member (228). In the event additional potential flow energy is required the weir (208) is attached to the upper section to increase output velocities of the fluid flow through the nozzles 222.

The structural frame body (208) may optionally be provided with leaf spring shoes or skis (230) providing support beneath the primary frame (208). The shoes (230) establish the location of the nozzles (222) with respect to the sediment and water depth in the pipe (12). The leaf springs (230) inherently allow the kite frame (208) to glide along the belly or lower interior surface of the pipe (12) and assist negotiating unforeseen obstacles within the pipe (12). Four shoes (23) may be provided, two front shoes (not shown) and two rear shoes (230), hence providing stability. The inherent concave shape or configuration allows the frame (208) to travel in both up and downstream directions. The sled shoes (230) are easily replaced in the event of wear.

The skids or shoes (23) may optionally include rollers (306) to support the cleaning plug (L) in the interior passageway of the tubular system (14) and to increase the mobility of the cleaning plug (L) within the interior (10) of the pipe (12).

The apron (214) is preferably of a canvas or other suitable type of pliable material attached to the primary frame (208) optionally using simple beam springs (216). The springs (216) provide a biased outward force allowing the apron (214) to adhere to the inside walls (70) or ever changing contour of the pipe (12) capturing flow in a skirt type fashion. The beam springs (216) are also optionally of a convex nature and thus allow retrieval when the large scale system (L) is pulled upstream thereby preventing damage to the apron or skirt (214).

Referring particularly to FIG. 2, the entire assembly (L) may be allowed to run out using a constant tension winch (232) provided at the surface (36). A swivel (234) prevents a multiple point sling arrangement (236) from fowling and assist maintenance of verticality. The multiple point sling arrangement (236) may be fastened to the frame (208) at strategic locations associated with the mean centroid of the combined potential and kinetic energy forces associated with or without the addition of the optional weir member (228).

Figure 6:
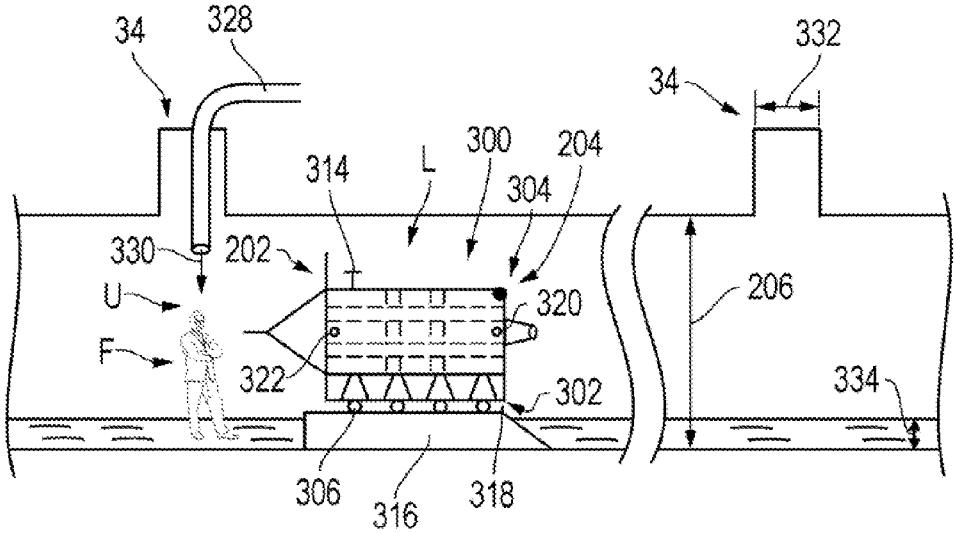
FIG. 6 is a schematic diagram of the present invention within a tubular system.
Figure 7:
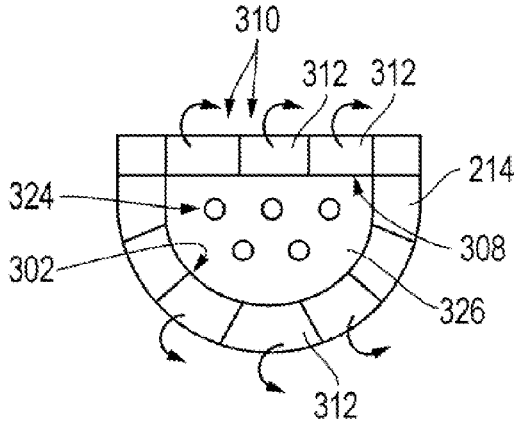
FIG. 7 is a frontal view of the upstream end of the large scale cleaning plug of the present invention.

Now referring particularly to the alternative embodiment shown in FIGS. 6 and 7, the present large scale cleaning plug system (L) is adaptable to be placed within an interior passageway (10) of a tubular system (14) having a larger interior diameter (206) than the above described kites or cleaning systems. The cleaning plug (L) includes a skeletal frame structure (208) that is adapted to support an outer skin member (200) for containing and directing a fluid (F) through an interior central passageway (324) formed in the skeletal frame structure (208). The skeletal frame structure (208) is formed having a first end (202) and an opposing second end (204). The first end (202) is defined as being upstream of the second end (204) in relation to a fluid flow path through the interior passageway (10) of the tubular system (14) during operation of the large scale cleaning plug (L). The first end (202) is also formed having an opening (326) therethrough for the passage of the fluid.

The skeletal frame structure (208) has a middle segment (300) comprising a generally frustoconically shaped bottom element (302) that itself has a first end (320) and a truncated opposite second end (322). The first end (320) through to the second end (322) of the middle segment (300) has a width selected to fit within the interior passageway (10) of the pipe (12).

A securing means or rigging (236) may be connected to the skeletal frame structure (208) in proximity to the first end (202) for controllably securing the skeletal frame structure (208) in desired positions within the interior passageway (10) of the tubular system (14).

The second end (204) of the skeletal frame structure (208) is formed having a rear segment (304) that supports at least one nozzle assembly (220). The nozzle assembly (220) includes at least one nozzle body (222) that extends from a plate (226) preventing appreciable fluid flow therethrough while at the same time permitting a desired fluid flow through an exit opening (223) of the nozzle body (222).

Preferably the middle segment (300) is formed having an exterior skin member (200) composed of a flexible or plastic type material that is essentially impervious to the fluid flow, such as a polyethylene sheet. Because of the buoyancy of the outer skin member (200), additional weight may be needed to be added to the frame structure (208) to prevent the floating of the cleaning plug (L).

The first end (202) of the skeletal frame structure (208) may have an apron or flange portion (214) surrounding at least a portion of the opening that is formed in or communicates the fluid through the first end (202) of the skeletal frame (208). It is desired that the apron or flange portion (214) be adapted to controllably block the fluid flow during operation of the cleaning plug within the interior passageway of the tubular system. One way to control the blocking or flowing of the fluid by the apron member is to form the apron (214) with a plurality of independent segments that can be controllably positioned to permit a desired fluid flow past the cleaning plug (L).

The skeletal frame structure (208) can be adapted to be disassembled as desired into one or more component members such that the component members are suitably sized for passing through an opening smaller than the interior passageway (10) of the tubular system (14) and to be reassembled within the interior passageway (10) of the tubular system (14). This is important when interior diameter (206) of the sewer pipe (12) is larger than the diameter (332) of the manhole access (34).

The large scale cleaning plug (L) can be reassembled on a ramp body (316) that raises the cleaning plug (L) above the flowing fluid level or water depth (334). This ramp (316) would reduce the impact of the sewer fluid that makes reassembly more difficult when a portion of the cleaning plug (L) is immersed in the flowing fluid (F). When desired a lock (318) can be released by the operator or user (U) permitting the cleaning plug (L) to move off the ramp (316) and into the fluid current.

As described above the nozzle bodies (222) are comprise generally frustoconical shaped members extending from a plate member (226) preventing appreciable fluid flow therethrough and permitting a desired fluid flow through an exit opening (223) through the middle segment (300).

The preferred arrangement for the cleaning plug (L) has the second end (204) of the middle segment (300) has a width less than the width of the first end (202). Also the middle segment (300) has a flattened upper surface (308).

Optionally, the nozzle assembly (220) or the nozzle bodies (222) may be pivotally mounted to the second end (204) such that they can be positioned for maximum sweeping force applied to the debris in the pipe downstream of the cleaning plug (L).

Preferably a top portion of the first end (202) of the skeletal frame structure (208) is adapted to permit a controlled amount of fluid flow (F) over the middle segment (300) as was described above. The fluid flowing over the top of the cleaning plug (L) may benefit from the airfoil effect from the difference in the fluid flowing within the cleaning plug (L) and the fluid flowing over the top of the cleaning plug (L).

A segmented apron (310) may mounted in proximity to the first end (202) of the skeletal frame structure (208) and surrounding a portion of the opening formed in the first end (202) of the skeletal frame structure (208) and one or more segments (312) of the apron (214) being controllably positioned using control (314) to permit the fluid flow over the middle segment (300).

FIG. 6 also demonstrates that an optional hose (328) can enter the pipe (12) upstream of the cleaning plug (L) to add more water or other liquid (330) to increase the fluid level (334) or the velocity or quantity of the fluid flowing through the pipe (12).

The foregoing disclosure and description of the invention are illustrative and explanatory thereof, and various changes in the size, shape and materials, as well as in the details of the illustrated construction may be made without departing from the spirit of the invention.

The invention claimed is:

1. A large scale cleaning plug system adaptable to be placed within an interior passageway of a tubular system, the plug comprising:

a skeletal frame structure adapted to support an outer skin member for containing and directing a fluid through an interior central passageway formed in the skeletal frame structure; the skeletal frame structure having a first end and an opposing second end; the first end being upstream of the second end in relation to a fluid flow path through the interior passageway of the tubular system during operation of the large scale cleaning plug and the first end formed having an opening therethrough for the passage of the fluid;

the first end and the second end of the skeletal frame structure each having a width less than a width of the interior passageway of the tubular system;

the skeletal frame structure formed having a middle segment comprising a generally frustoconical shaped bottom element having a downstream first end and a truncated opposite second end; said first end and said second end of the middle segment having a width selected to fit within the interior passageway of the tubular system;

securing means connected to the skeletal frame structure in proximity to the first end for controllably securing the skeletal frame structure in desired positions within the interior passageway of the tubular system; and, the second end of the skeletal frame structure formed having a rear segment supporting at least one nozzle assembly; said nozzle assembly having at least one nozzle body extending from a plate preventing appreciable fluid flow therethrough and permitting a desired fluid flow through an exit opening of the nozzle bodies.

2. The invention of claim 1 in which the middle segment is formed having an exterior skin member composed of a flexible material.

3. The invention of claim 1 wherein the middle segment includes an exterior skin member formed of a plastic.

4. The invention of claim 1 wherein the middle segment is formed having an exterior skin member composed of a material essentially impervious to the fluid flow.

5. The invention of claim 1 further wherein the first end of the skeletal frame structure has an apron portion surrounding at least a portion of the opening formed in the first end of the skeletal frame; the apron portion adapted to controllably block the fluid flow during operation of the cleaning plug within the interior passageway of the tubular system.

6. The invention of claim 5 wherein the apron is formed having a plurality of independent segments.

7. The invention of claim 6 wherein one or more segments of the apron can be controllably positioned to permit a desired fluid flow past the cleaning plug.

8. The invention of claim 1 wherein the skeletal frame structure is adapted to be disassembled into component members suitable for passing through an opening smaller than the interior passageway of the tubular system and to be reassembled within the interior passageway of the tubular system.

9. The invention of claim 1 wherein the nozzle bodies are comprise generally frustoconical shaped members extending from a plate member preventing appreciable fluid flow therethrough and permitting a desired fluid flow through an exit opening of the middle segment.

10. The invention of claim 1 wherein the nozzle bodies include a check valve.

11. The invention of claim 1 wherein the nozzle bodies are composed of rubber.

12. The invention of claim 1 wherein the tubular system is a known sewer system pipe.

13. The invention of claim 1 wherein the second end of the middle segment has a width less than the width of the first end of the middle segment.

14. The invention of claim 1 wherein the nozzle assembly is pivotally mounted to the conical element.

15. The invention of claim 1 further including rollers mounted with the middle segment to support the cleaning plug in the interior passageway of the tubular system.

16. The invention of claim 1 wherein a top portion of the first end of the skeletal frame structure is adapted to permit a controlled amount of fluid flow over the middle segment.

17. The invention of claim 16 further including a segmented apron mounted in proximity to the first end of the skeletal frame structure and surrounding a portion of the opening formed in the first end of the skeletal frame structure and one or more segment of the apron being controllably positioned to permit the fluid flow over the middle segment.

18. The invention of claim 1 wherein the middle segment has a flattened upper surface.

* * * * *